US008444254B2

(12) United States Patent
Han

(10) Patent No.: US 8,444,254 B2
(45) Date of Patent: May 21, 2013

(54) APPARATUS AND METHOD OF PROTECTING INKJET PRINTER HEAD

(75) Inventor: Chun-ku Han, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 677 days.

(21) Appl. No.: 12/567,844

(22) Filed: Sep. 28, 2009

(65) Prior Publication Data

US 2010/0171777 A1 Jul. 8, 2010

(30) Foreign Application Priority Data

Jan. 6, 2009 (KR) ..... 10-2009-0000847

(51) Int. Cl.
*B41J 2/05* (2006.01)

(52) U.S. Cl.
USPC ..... 347/57

(58) Field of Classification Search ..... 347/10, 347/57
See application file for complete search history.

(56) References Cited

U.S. PATENT DOCUMENTS

| | | | | |
|---|---|---|---|---|
| 5,519,416 | A * | 5/1996 | Hayasaki et al. | 347/13 |
| 6,471,321 | B1 * | 10/2002 | Aono et al. | 347/14 |
| 6,712,438 | B2 * | 3/2004 | Han | 347/12 |
| 2008/0180471 | A1 * | 7/2008 | Han | 347/9 |
| 2011/0273507 | A1 * | 11/2011 | Yamato et al. | 347/19 |

FOREIGN PATENT DOCUMENTS

| | | | |
|---|---|---|---|
| JP | 06008503 | A * | 1/1994 |
| KR | 20-0146386 | | 2/1999 |
| KR | 20080071350 | | 8/2008 |

* cited by examiner

*Primary Examiner* — Charlie Peng
(74) *Attorney, Agent, or Firm* — Stanzione & Kim, LLP

(57) ABSTRACT

An apparatus and method to protect an inkjet printer head including a head controller of a printer body and a head chip to drive a heater by using a serial interface, the apparatus including: a clock monitoring unit to monitor a serial clock signal that is used as a reference clock signal supplied to the head chip to control the head chip, and if the serial clock signal is abnormal, to output a signal indicating that the serial clock signal is abnormal; and a heater driving limiting unit to limit energy applied to the heater by using the signal, which is output by the clock monitoring unit, to indicate that the serial clock signal is abnormal.

16 Claims, 11 Drawing Sheets

APPARATUS AND METHOD OF PROTECTING INKJET PRINTER HEAD

CROSS-REFERENCE TO RELATED APPLICATIONS

This application claims the priority from Korean Patent Application No. 10-2009-0000847, filed on Jan. 6, 2009, in the Korean Intellectual Property Office, the disclosure of which is incorporated herein in its entirety by reference.

BACKGROUND

1. Field of the Invention

The present general inventive concept relates to an inkjet printer, and more particularly to, an apparatus and method of protecting an inkjet printer head that prevents a heater from being damaged due to an abnormal operation of a printer.

2. Description of the Related Art

A thermal inkjet printer head, which includes a nozzle, a heater, and an ink chamber disposed above each heater, instantly heats each heater, ejects ink droplets, and forms an image.

Energy applied to a heater is calculated as voltage (V)*current (A)*fire pulse width. When energy is applied to the heater over a predetermined period of time, ink droplets are ejected from a nozzle. However, if excessively high energy is applied to the heater, the heater electrically burns out, and a nozzle fails to print an image, which causes a white line in the image. Such a white line is indicative of a hardware failure and the heater can not be recovered. Thus, when numerous amounts of nozzles fail, thereby causing the white lines, replacement of the inkjet printer head is required.

Therefore, a protection circuit is needed to prevent energy from being excessively applied to the heater so that a head chip is not damaged

SUMMARY

The present general inventive concept provides an apparatus and method of protecting an inkjet printer head that prevents a heater from electrically burning out, which is caused by an unlimited increase of a width of a heater driving fire pulse and a continuous driving of the heater at a relatively high frequency when a period of a reference clock signal transmitted to a head chip has substantially increased or the reference clock signal instantly does not operate (the reference lock signal maintains "H" or "L"), in abnormal conditions.

Additional features and/or utilities of the present general inventive concept will be set forth in part in the description which follows and, in part, will be obvious from the description, or may be learned by practice of the general inventive concept.

Exemplary embodiments of the present general inventive concept provides an apparatus to protect an inkjet printer head which includes a head controller of a printer body and a head chip to drive a heater by using a serial interface, the apparatus includes a clock monitoring unit to monitor a serial clock signal that is used as a reference clock signal supplied to the head chip from the head controller to control the head chip, and if the serial clock signal is abnormal, to output a signal indicating that the serial clock signal is abnormal, and a heater driving limiting unit to limit energy applied to the heater of the printer head by using the signal, which is output by the clock monitoring unit, to indicate that the serial clock signal is abnormal.

Exemplary embodiments of the present general inventive concept also provide a method of protecting an inkjet printer head including a head controller of a printer body and a head chip to drive a heater by using a serial interface, the method includes performing sampling with regard to a serial clock signal that is used as a reference clock signal supplied to the head chip from the head controller to control the head chip at a frequency higher than a frequency of the serial clock signal, counting the number of clocks including continuous 0 or 1 in the sampled clock signal, determining that the serial clock signal is abnormal if a count value is greater than a previously established value, and limiting energy applied to the heater of the printer head if the serial clock signal is abnormal.

Exemplary embodiments of the present general inventive also provide a protection apparatus of an inkjet printer having a head controller, a heater, and a head chip to drive the heater, the protection apparatus including a clock monitoring unit to determine whether a first signal representing a reference clock signal from the head controller used to control the head chip is in a first condition or in a second condition, the first condition representing a normal first signal and the second condition representing an abnormal first signal, and a heater driving limiting unit to limit energy applied to the heater when the first signal is in the second condition.

The clock monitoring unit may include a clock sampling unit to sample the first signal at a frequency higher than a frequency of the first signal, a clock counter to count a number of clocks including continuous 0 or 1 in the sampled first signal, and an abnormal clock signal determination unit to compare a count value obtained by the clock counter with a predetermined value and to output a second signal representing an abnormal first signal when the count value is larger than the predetermined value.

The heater driving limiting unit may limit a driving of the heater according to the second signal, a third signal having a pulse width corresponding to printing data generated by the head chip, and a fourth signal to limit a pulse width of the third signal to protect the heater.

Exemplary embodiments of the present general inventive also provide an apparatus to protect an inkjet printer head having a head controller and a heater, the apparatus including a head chip to receive printing data from the head controller and to output a heater driving pulse width according to the printing data and a reference clock signal to the heater, and a heater driving limiting unit to control a width of the heater driving pulse width output to the heater based on a condition of the printing data and the reference clock signal.

The apparatus may further include a clock monitoring unit to determine whether the printing data and the reference clock signal is in a normal condition or in an abnormal condition, wherein the heater driving limiting unit to limit energy output to the heater when at least one of the printing data and the reference clock signal is in the abnormal condition.

Exemplary embodiments of the present general inventive also provide an image forming apparatus having a heater and a head chip to drive the heater which includes a clock monitoring unit to monitor a reference signal to control the head chip, and a controller to control the head chip to restrict driving of the heater according to characteristic of the reference signal.

The clock monitoring unit may further include a clock sampling unit to sample the reference signal at a frequency higher than a frequency of the reference signal, a clock counter to count a number of clocks including continuous 0 or 1 in the sampled reference signal, and an abnormal clock signal determination unit to compare a count value obtained by the clock counter with a predetermined value and to output a second signal representing an abnormal reference signal when the count value is larger than the predetermined value.

The controller may limit driving of the heater according to the second signal, a third signal having a pulse width corresponding to printing data generated by the head chip, and a fourth signal to limit a pulse width of the third signal to protect the heater.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
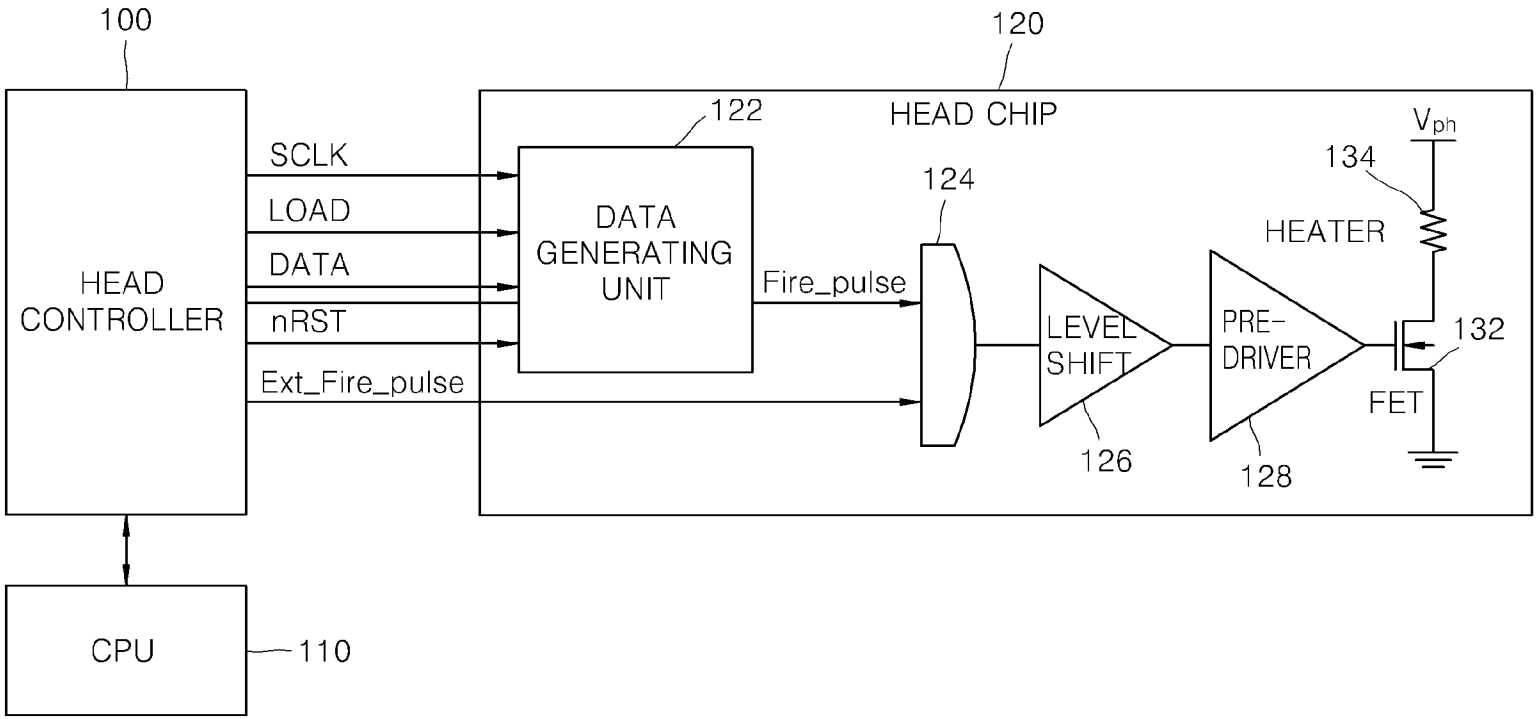
FIG. 1 is a schematic dataflow diagram of an apparatus to protect an inkjet printer head according to an exemplary embodiment of the present general inventive concept.

Hereinafter, the present general inventive concept will be described in detail by explaining exemplary embodiments of the general inventive concept with reference to the attached drawings, wherein like reference numerals refer to the like elements throughout. The exemplary embodiments are described below in order to explain the present general inventive concept by referring to the figures.

A voltage and current that are applied to a heater use systematically fixed values, to prevent an excessive application of energy to the heater. However, a pulse width that affects the energy applied to the heater is established by serial data transmitted to a head through a data interface (in a serial manner). Thus, if data is erroneously transmitted, an excessive pulse width is established and thus excessive energy may be applied to the heater which, in turn, may cause the heater to electrically burn out.

Although the data interface is erroneously established, the heater can be protected by an external driving signal by combining a heater driving signal and the external driving signal to prevent the heater from electrically burning out.

FIG. 1 is a schematic dataflow diagram of an apparatus of protecting an inkjet printer head according to an exemplary embodiment of the present general inventive concept. Referring to FIG. 1, a central processing unit (CPU) 110 processes printing data received from a computer (not illustrated) and transmits the printing data to a head controller 100.

The head controller 100, which is a data transmission block, corrects the printing data received from the CPU 110 according to a head format, and transmits the printing data to a head chip 120 through a serial interface (a serial clock signal (SCLK), a load, and data signals). However, the present general inventive concept is not limited thereto.

The head chip 120 includes a data generating unit 122, a level shift 126, and a pre-driver 128. The data generating unit 122 selects a heater corresponding to the data received from the head controller 100 through the serial interface, and generates a heater driving pulse width by using the SCLK signal as a reference clock signal.

The level shift 126 converts a signal level output by the data generating unit 122 into a level used to drive a field-effect transistor (FET) 132.

The pre-driver 128 is a FET driving circuit to drive the FET 132. Energy is applied to a heater 134 through the FET 132.

Figure 2:
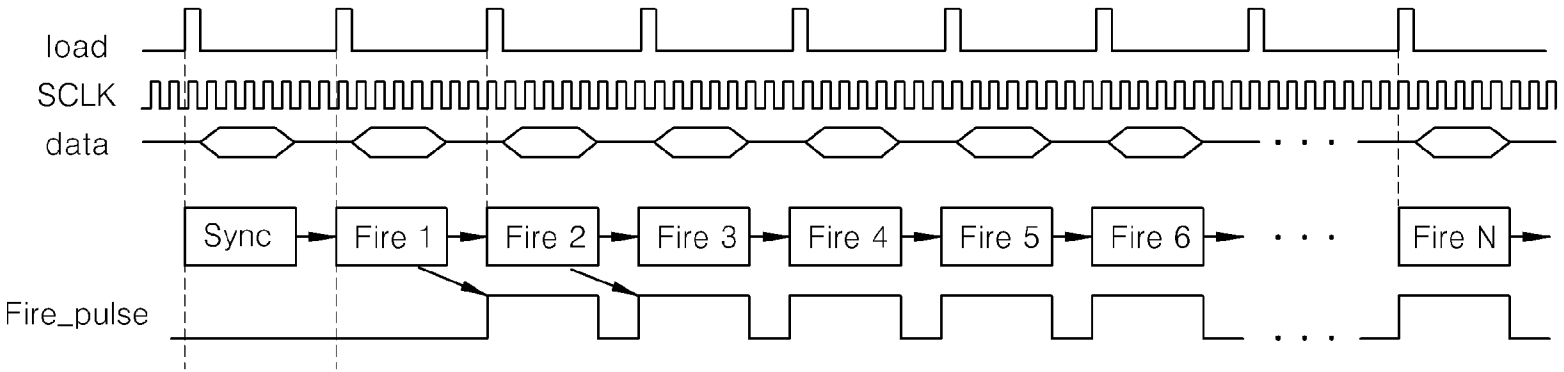
FIG. 2 is a timing diagram illustrating an operation of the apparatus to protect the inkjet printer head of FIG. 1.

FIG. 2 is a timing diagram illustrating an operation of the apparatus to protect the inkjet printer head of FIG. 1. Referring to FIG. 2, the operation of the apparatus to protect the inkjet printer will now be described.

A plurality of segments of data e.g., a fire pulse width, a fire start, etc. relating to driving of a heater are established by using sync data transmitted from the head controller 100, a number of a heater that will be driven is selected from firing data, and heaters that are previously selected from a next firing group are driven during a time of fire pulse width. A fire pulse signal is operated during time corresponding to a number of a SCLK cycle set in the sync data.

If a fire pulse width increases due to an error, e.g., a data transmission error and a fire pulse establishment error, energy is excessively applied to the heater that is driven, so that the heater is electrically open, causing deterioration in a printed image.

In this regard, performing an AND operation on an external fire pulse Ext_Fire transmitted from the head controller 100 to the head chip 120 and the fire pulse signal generated by the data generating unit 122 of the head chip 120 may prevent the heater from electrically burning out.

Figure 3:
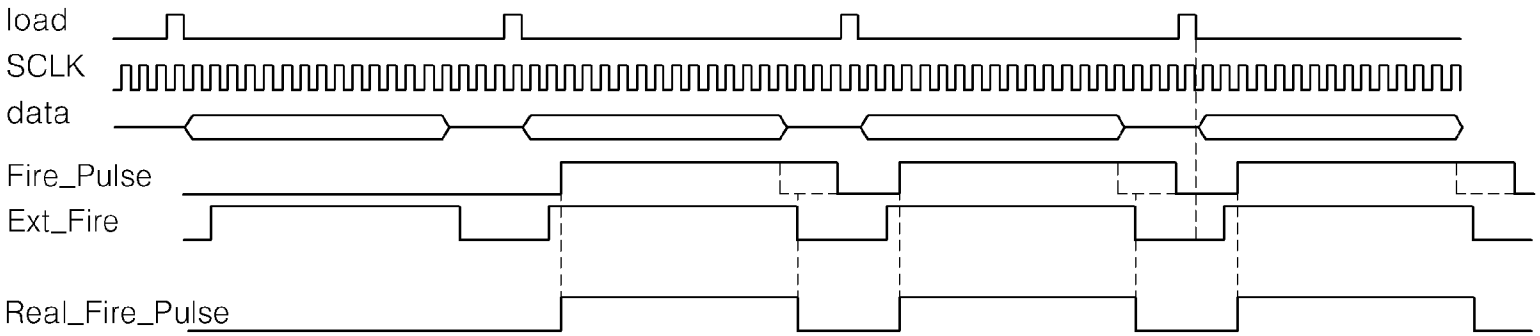
FIG. 3 is a timing diagram of a fire pulse signal that increases due to an error.

FIG. 3 is a timing diagram of a width of a fire pulse signal Fire_Pulse that increases due to an error. Referring to FIG. 3, even if the fire pulse signal Fire_Pulse is established by a larger value than an originally established value, an actually driven pulse signal Real_Fire_Pulse can apply energy necessary for driving a heater by using an output signal obtained by performing an AND operation on a signal Ext_Fire provided by the head controller 100 and the signal Ext_Fire through a logical gate 124, to thereby prevent the heater from electrically burning out.

In order to prevent the width of the fire pulse signal Fire_Pulse from increasing due to the error, performing an AND operation on the fire pulse signal Fire_Pulse and a signal Ext_Fire_Pulse can prevent the width of the fire pulse signal Fire_Pulse from increasing as compared to the originally established value, in abnormal conditions.

Figure 4:
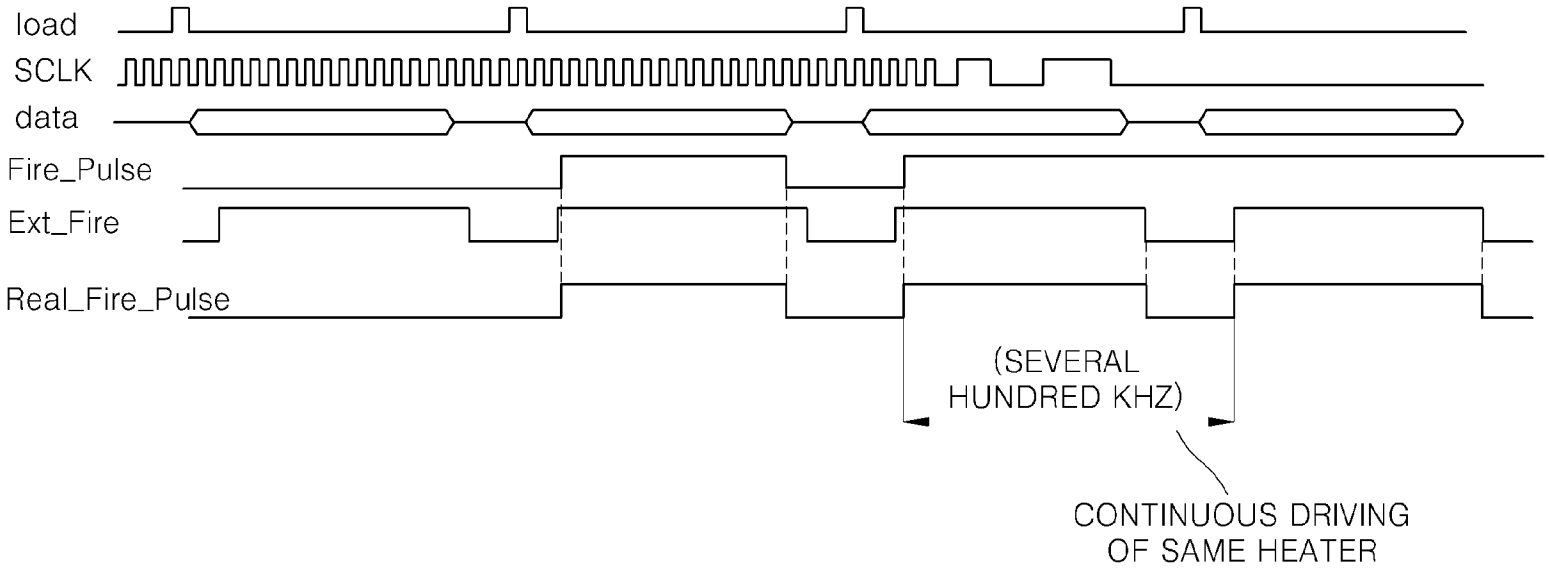
FIG. 4 is a timing diagram of a serial clock signal (SCLK) transmitted from a head controller to a data generating unit of a head chip that has an increasing cycle or does not operate for a moment, in abnormal conditions.

However, referring to FIG. 4, when an SCLK signal transmitted from a head controller 100 to a data generating unit 122 of a head chip 120 has an increasing cycle or does not operate for a moment in abnormal conditions, for example, when the SCLK signal is maintained high or low, the width of the fire pulse signal Fire_Pulse increases unlimitedly. Although the heater is driven at a frequency below 30 KHz in normal conditions, if the width of the fire pulse signal Fire_Pulse unlimitedly increases, the heater is continuously driven at a very high frequency (several hundred KHz), and the heater may electrically burn out.

The present general inventive concept prevents a width of a fire pulse signal Fire_Pulse from increasing unlimitedly due to an abnormal SCLK signal.

Figure 5:
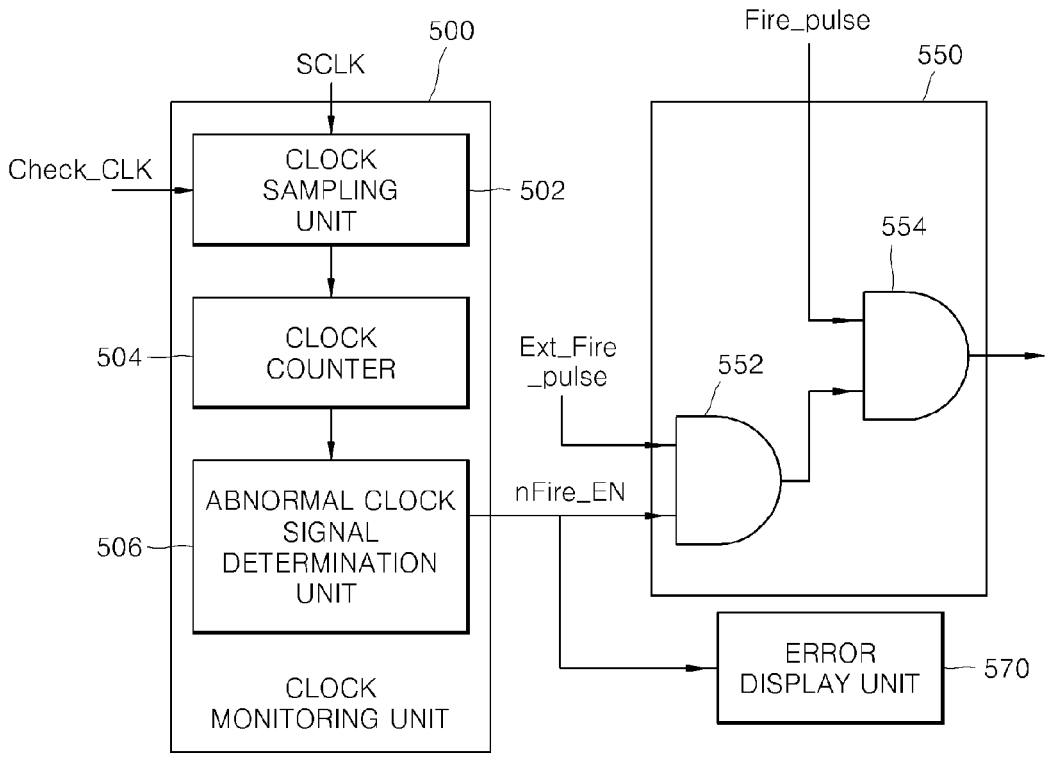
FIG. 5 is a schematic dataflow diagram of an apparatus to protect an inkjet printer head according to another exemplary embodiment of the present general inventive concept.

FIG. 5 is a schematic dataflow diagram of an apparatus of protecting an inkjet printer head according to another exemplary embodiment of the present general inventive concept. Referring to FIG. 5, when the inkjet printer head includes a head controller 100 of a printer body and a printer head chip 120 for driving a heater 134 through a serial interface, the apparatus to protect the inkjet printer head includes a clock monitoring unit 500 and a heater driving limiting unit 550, and may further include an error display unit 570.

The clock monitoring unit 500 monitors a serial clock signal SCLK that is used as a reference clock signal supplied to the head chip 120 from the head controller of the printer body for controlling the head chip 120, and outputs a signal nFire_EN indicating that the serial clock signal SCLK is abnormal if the serial clock signal SCLK is abnormal, and includes a clock sampling unit 502, a clock counter 504, and an abnormal clock signal determination unit 506. In exemplary embodiments, the clock sampling unit 502 performs sampling with regard to the serial clock signal SCLK supplied to the head chip 120 at a frequency Check_CLK that is higher than a frequency of the serial clock signal SCLK. In alternative exemplary embodiments the frequency Check_CLK may be higher than twice the frequency of the serial clock signal SCLK. However, the present general inventive concept is not limited thereto.

The clock counter 504 counts a number of clocks including continuous 0 or 1 in the clock signal sampled by the clock sampling unit 502.

The abnormal clock signal determination unit 506 determines if a count value obtained by the clock signal counter 504 is greater than a previously established value, and if the count value is greater than the previously established value, determines that the serial clock signal SCLK is abnormal, and outputs the signal nFire_EN to indicate that the serial clock signal SCLK is abnormal.

The heater driving limiting unit 550 limits energy applied to the heater 134 of the printer head by using the signal nFire_EN, which is output by the clock monitoring unit 500, indicating that the serial clock signal SCLK is abnormal.

In more detail, the heater driving limiting unit 550 limits the driving of the heater 134 by performing a logical operation with regard to the signal nFire_EN indicating that the serial clock signal SCLK is abnormal, a head driving signal Fire_Pulse having a heater driving pulse width corresponding to printing data generated by the head chip 120, and a signal ext Fire_Pulse for limiting a pulse width of the head driving signal Fire_Pulse to prevent the heater from electrically burning out.

In exemplary embodiments, the logical operation may be performed by using two logical gates, i.e. a first AND gate 552 and a second AND gate 554. However, the present general inventive concept is not limited thereto.

The first AND gate 552 performs an AND operation on the signal nFire_EN indicating that the serial clock signal SCLK is abnormal and the signal ext Fire_Pulse for limiting the pulse width of the head driving signal Fire_Pulse to prevent the heater 134 from electrically burning out.

The second AND gate 554 performs the AND operation on an output signal of the first AND gate 552 and the head driving signal Fire_Pulse having the heater driving pulse width corresponding to the printing data generated by the head chip 120.

The error display unit 570 reads the signal nFire_EN and displays an error message if the signal nFire_EN indicating that the serial clock signal SCLK is abnormal is enabled in the clock monitoring unit 500.

Figure 6:
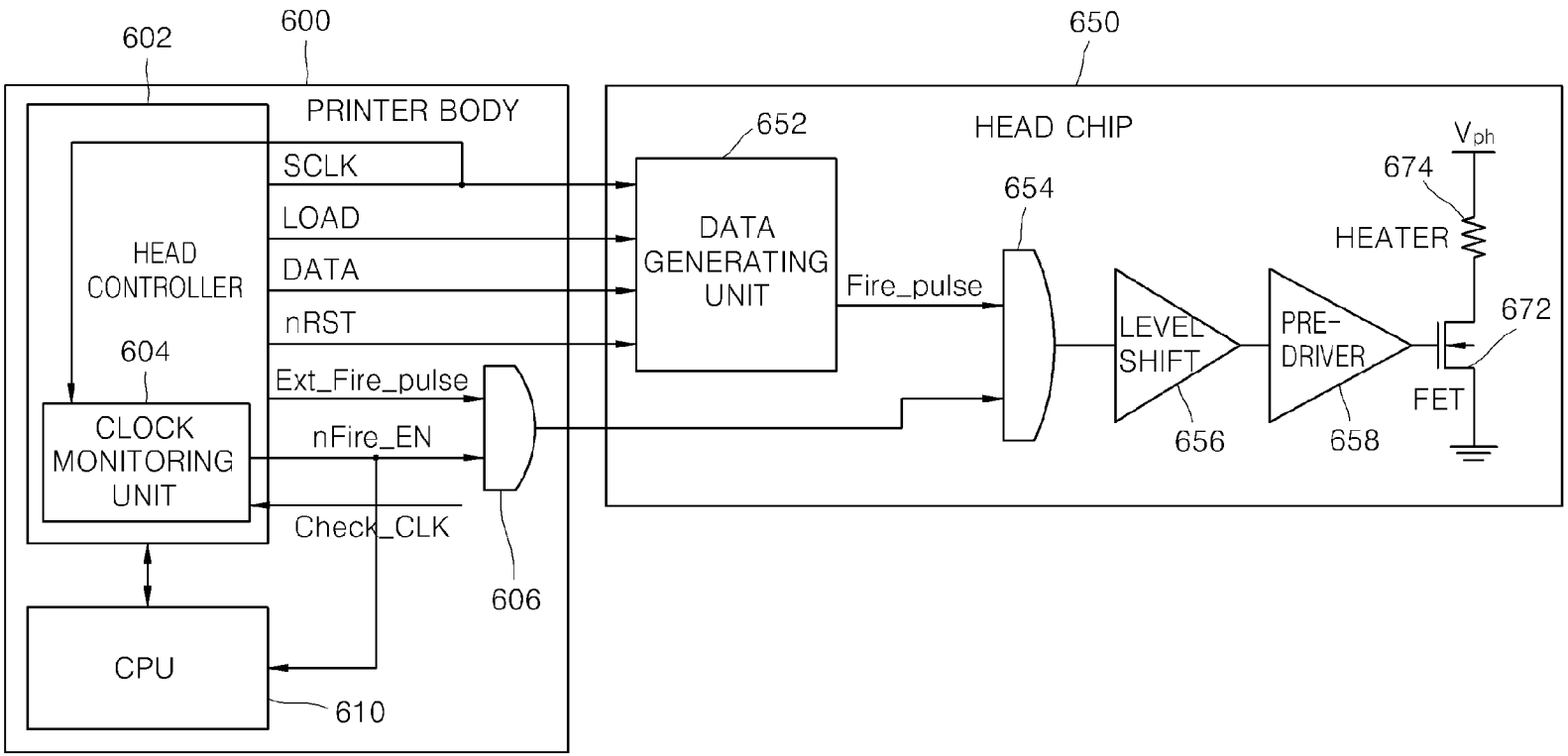
FIG. 6 is a schematic dataflow diagram of an apparatus to protect an inkjet printer head according to another exemplary embodiment of the present general inventive concept.

FIG. 6 is a schematic dataflow diagram of an apparatus to protect an inkjet printer head according to another exemplary embodiment of the present general inventive concept. Referring to FIG. 6, the apparatus to protect the inkjet printer head includes a CPU 610, a head controller 602, and a head chip 650.

The CPU 610 processes printing data received from a computer (not illustrated) and transmits the printing data to the head controller 602.

The head controller 602 corrects the printing data received from the CPU 610 in a head format, and transmits the printing data to the head chip 650 through a serial interface (a serial clock signal (SCLK), a load, and data signals). However, the present general inventive concept is not limited thereto.

The head controller 602 may include a clock monitoring unit 604 that is the same as the clock monitoring unit 500 illustrated in FIG. 5. The clock monitoring unit 604 checks a cycle of the SCLK signal by using a separate external clock of a frequency higher than that of the SCLK signal, and detects an error of the SCLK signal. If the clock monitoring unit 604 detects the error of the SCLK signal, the clock monitoring unit 604 disables a heater driving fire pulse. The detailed description thereof is the same as described with reference to FIG. 5, and therefore a detailed description will be omitted. In exemplary embodiments, the clock monitoring unit 604 may not be included in the head controller 602 and may be excluded from the head controller 602.

In exemplary embodiments, the head chip 650 includes a data generating unit 652, a level shift 656, and a pre-driver 658.

The data generating unit 652 selects a heater 674 corresponding to the data received from the head controller 602 through the serial interface, and generates a heater driving pulse width by using the SCLK signal as a reference clock.

The level shift 656 converts a signal level output by the data generating unit 652 into a level used to drive a FET 672.

The pre-driver 658 is a FET driving circuit used to drive the FET 672.

Figure 7:
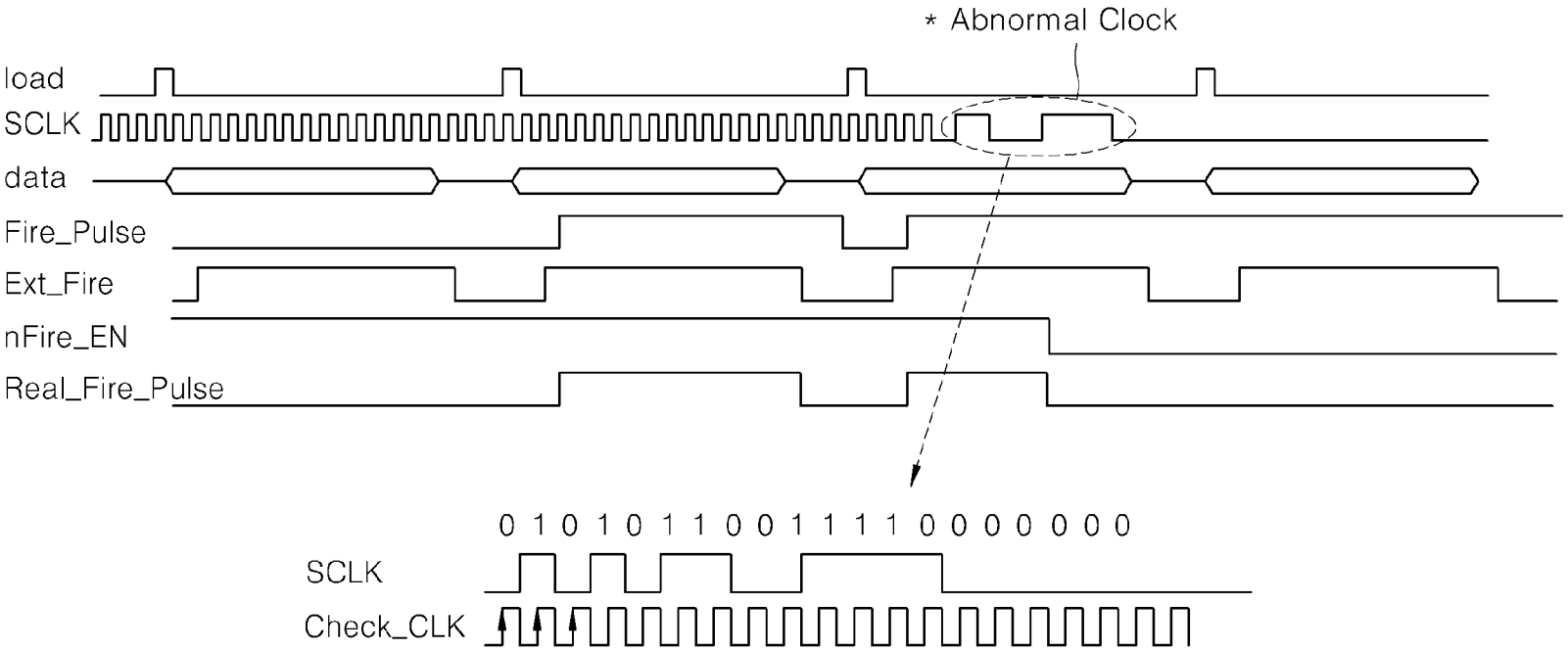
FIG. 7 is a timing diagram illustrating an operation of the apparatus to protect the inkjet printer head of FIGS. 5 and 6.
Figure 8:
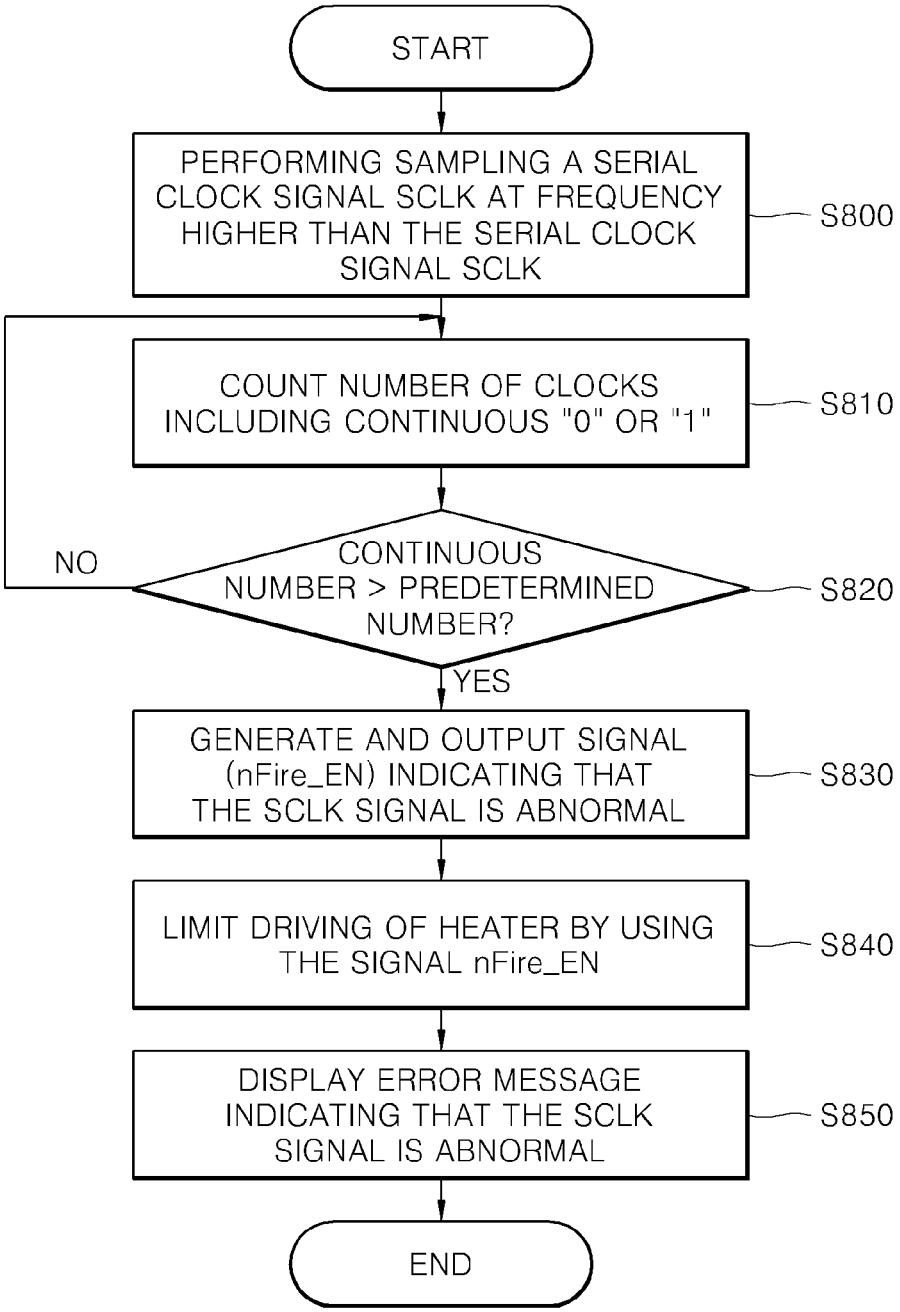
FIG. 8 is a flowchart illustrating a method to protect an inkjet printer head according to an exemplary embodiment of the present general inventive concept.

FIG. 7 is a timing diagram illustrating an operation of the apparatus of protecting the inkjet printer head of FIGS. 5 and 6. FIG. 8 is a flowchart illustrating a method of protecting an inkjet printer head according to an exemplary embodiment of the present general inventive concept.

Referring to FIGS. 7 and 8, the method of protecting the inkjet printer head and the operation of the apparatus of protecting the inkjet printer head of FIG. 5 will now be described in detail.

In operation S800, sampling is performed with regard to the serial clock signal SCLK that is used as a reference clock signal supplied to the head chip 650 from the head controller 602 of the printer body 600 to control the head chip 650 at a frequency higher than that of the serial clock signal SCLK. In more detail, the serial clock signal SCLK transmitted from the head controller 602 to the head chip 650 is fed back to the clock monitoring unit 604 and is sampled at an external clock frequency (Check_CLK≧2*SCLK) that may be more than twice the frequency of the serial clock signal SCLK. However, the present general inventive concept is not limited thereto.

In operation S810, a value including 0 or 1 that continues in the sampled value is counted.

In operation S820, it is determined whether the obtained count value is larger than a predetermined value, and if the count value is larger than the predetermined value, it is determined that an error occurs in a clock and thus it is determined that the serial clock signal SCLK is abnormal. Accordingly, in operation S830, a signal nFire_EN indicating that the serial clock signal SCLK is abnormal is generated and is output as "L".

If the signal nFire_EN is generated, in operation S840, driving of the heater 674 is limited by using the signal nFire_EN.

In operation S850, the signal nFire_EN indicating that the serial clock signal SCLK is abnormal is read and an error message is displayed.

A level shift input is protected by performing an AND operation on the signal nFire_EN output by the clock monitoring unit 604 indicating that the serial clock signal SCLK is abnormal, a head driving signal Fire_Pulse having a heater driving pulse width corresponding to printing data generated by the head chip 650, and a signal ext Fire_Pulse used to limit a pulse width of the head driving signal Fire_Pulse to prevent the heater from electrically burning out, thereby limiting the driving of the heater 674 in operation 840.

However, the present general inventive concept is not limited thereto. That is, in exemplary embodiments, it is possible a signal ext Fire_Pulse can be used to temporarily terminate driving the heater until the temperature of the heater is lowered.

Figure 9:
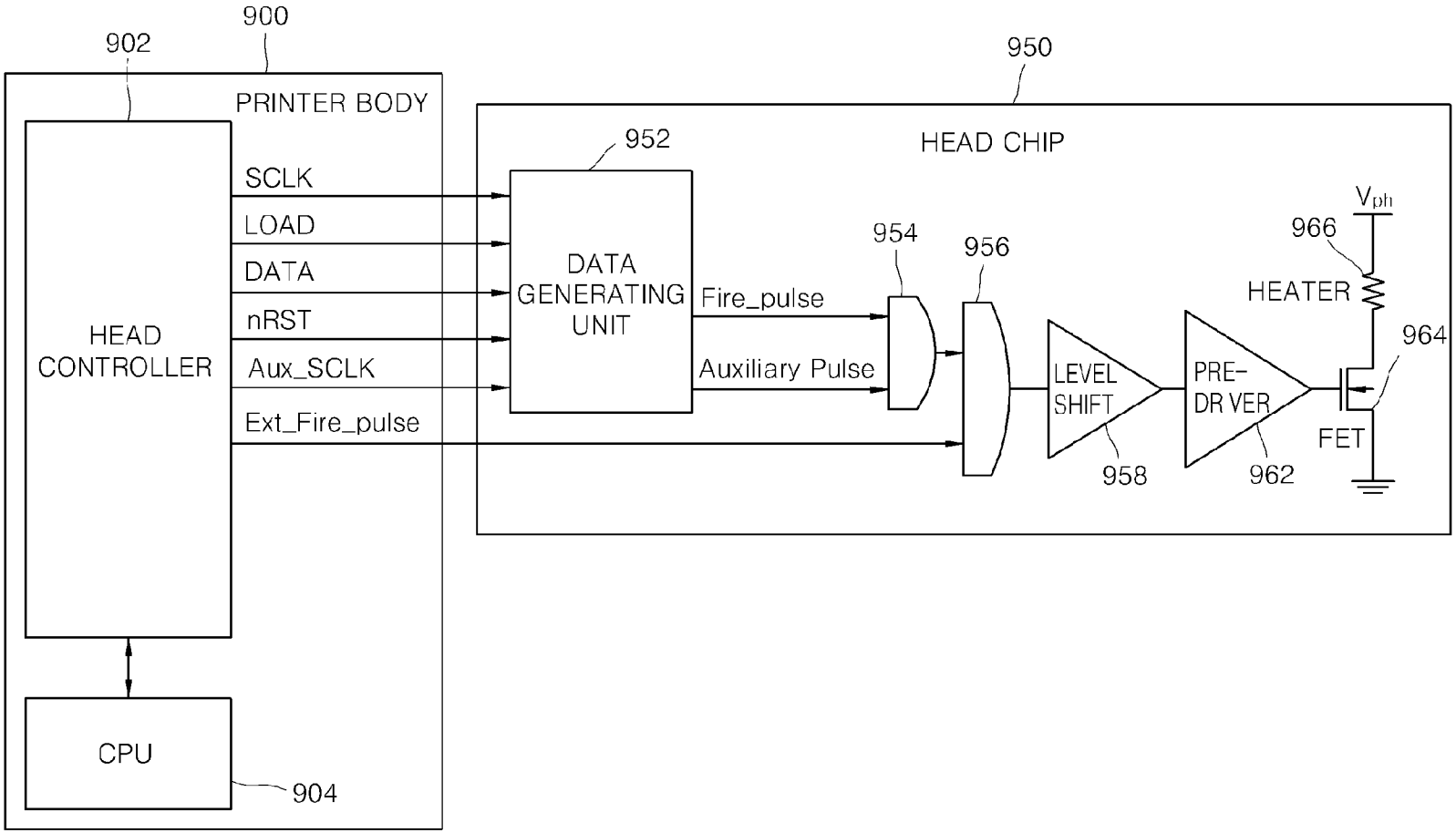
FIG. 9 is a schematic dataflow diagram of an apparatus to protect an inkjet printer head according to another exemplary embodiment of the present general inventive concept.
Figure 10:
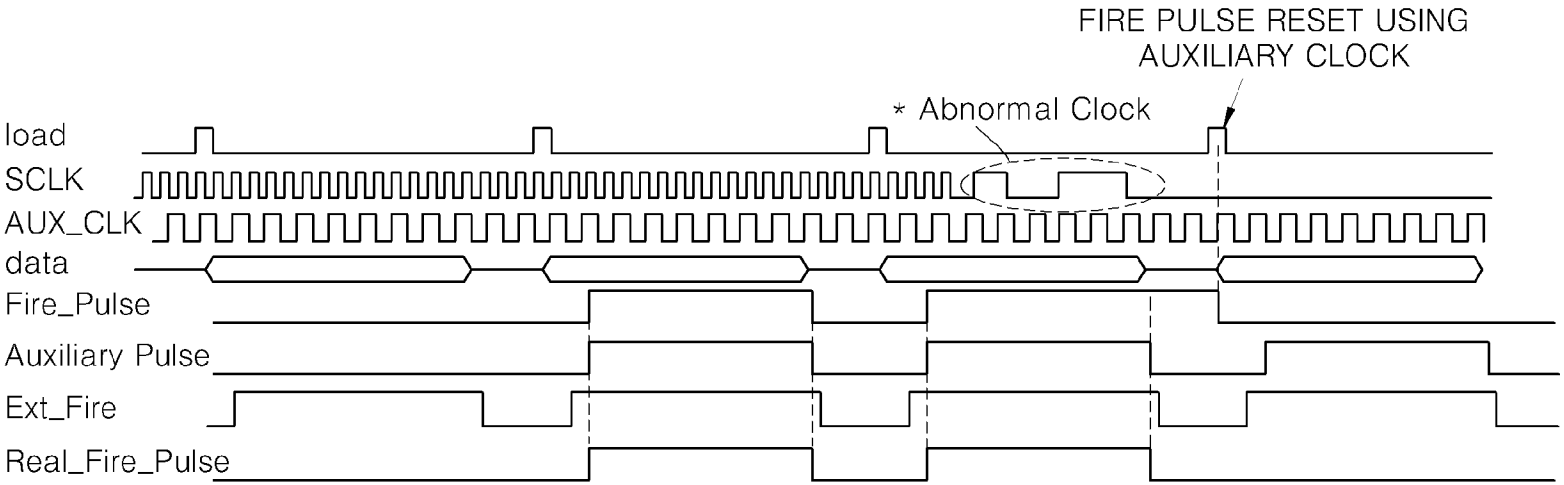
FIG. 10 is a timing diagram illustrating an operation of the apparatus to protect the inkjet printer head of FIG. 9.

Meanwhile, according to another exemplary embodiment, referring to FIG. 9, when a head controller 902 transmits an additional auxiliary clock signal Aux_SCLK, in addition to a SCLK signal, a load, and data signals, to a head chip 950, a data generating unit 952 of the head chip 950 generates fire and auxiliary pulse signals in which a fire pulse is synchronized with a main serial clock signal SCLK and an auxiliary clock signal (frequency: Aux_SCLK<SCLK), and performs an AND operation on the fire and auxiliary pulse signals. The load signal is transmitted to be synchronized with the main serial clock signal SCLK and the auxiliary clock signal Aux_SCLK. In this case, referring to FIG. 10, when an abnormal error occurs in the main serial clock signal SCLK during a transmission of data, a fire pulse protection is possible.

An apparatus and method to protect an inkjet printer head according to the present general inventive concept may prevent a heater from electrically burning out due to by an unlimited increase of a heater driving fire pulse and a continuous driving of the heater at a relatively high frequency of several hundred KHz, in spite of a normal frequency of 30 kHz, when a reference lock signal transmitted to a head chip has a significantly increasing cycle or instantly does not operate ("H" or "L" is maintained) in abnormal conditions.

Figure 11:
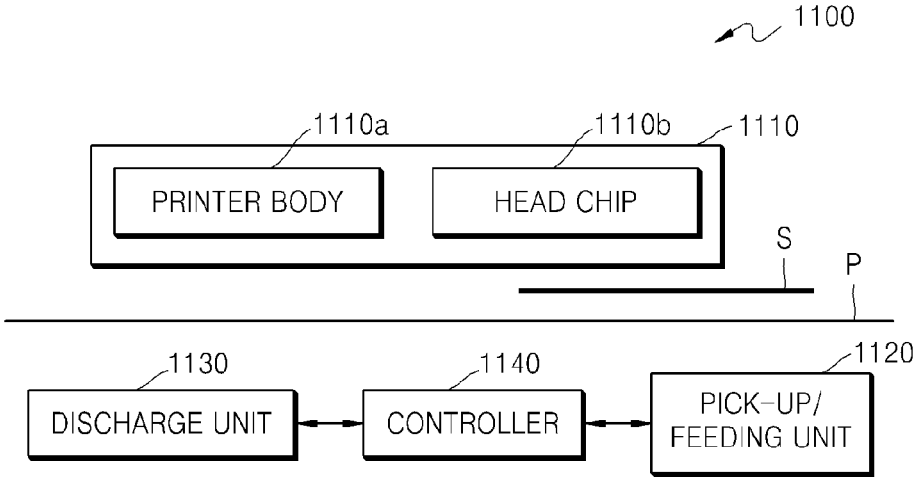
FIG. 11 is a schematic diagram illustrating an image forming apparatus according to an exemplary embodiment of the present general inventive concept.

FIG. 11 is a schematic diagram illustrating an image forming apparatus according to an exemplary embodiment of the present general inventive concept. In the present exemplary embodiment, the image forming apparatus 1100 includes a print unit 1110 having a printer body 1110*a* and a head chip 1110*b*. The printer body 1110*a* and the head chip 1110*b* are the same or similar to the printer body and head chip described above in reference to FIGS. 1 and 9. The image forming apparatus 1100 includes a pickup/feeding unit 1120, a discharge unit 1130, and a controller 1140 to control operations of the image forming apparatus 1100. The image forming apparatus 1110 further includes a paper path P disposed adjacent to the print unit 1110. In exemplary embodiments, the pickup/feeding unit 1120 retrieves a sheet of paper S from a paper source (not illustrated) and feeds the sheet S along the paper path P via instructions from the controller 1140. The print unit 1110 may be protected as described in previous exemplary embodiments.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

While the present general inventive concept has been particularly illustrated and described with reference to exemplary embodiments thereof, it will be understood by those skilled in the art that various changes in form and details may be made therein without departing from the spirit and scope of the present general inventive concept as defined by the following claims and their equivalents.

What is claimed is:

1. An apparatus to protect an inkjet printer head comprising a head controller of a printer body and a head chip to drive a heater by using a serial interface, the apparatus comprising:

a clock monitoring unit to monitor a serial clock signal that is used as a reference clock signal supplied to the head chip from the head controller to control the head chip, the serial clock signal being normal or abnormal and when the serial clock signal is abnormal, to output a signal indicating that the serial clock signal is abnormal; and a heater driving limiting unit to directly receive the signal from the clock monitoring unit and to limit energy applied to the heater by using the signal, which is output by the clock monitoring unit, to indicate that the serial clock signal is abnormal.

2. The apparatus of claim 1, wherein the clock monitoring unit comprises:

a clock sampling unit to perform sampling with regard to the serial clock signal supplied to the head chip at a frequency higher than a frequency of the serial clock signal;

a clock counter to count a number of clocks including continuous 0 or 1 in the sampled clock signal; and an abnormal clock signal determination unit to determine if a count value obtained by the clock counter is larger than a previously established value, and if the count value is larger than the previously established value, to determine that the serial clock signal is abnormal, and to output the signal indicating that the serial clock signal is abnormal.

3. The apparatus of claim 1, wherein the heater driving limiting unit limits driving of the heater by performing a logical operation with regard to the signal indicating that the serial clock signal is abnormal, a head driving signal having a heater driving pulse width corresponding to printing data generated by the head chip, and a signal for limiting a pulse width of the head driving signal to prevent the heater from electrically burning out.

4. The apparatus of claim 3, wherein the logical operation is performed by using:

a first AND gate performing an AND operation on the signal indicating that the serial clock signal is abnormal and the signal for limiting the pulse width of the head driving signal to prevent the heater from electrically burning out; and a second AND gate performing an AND operation on an output signal of the first AND gate and the head driving signal having the heater driving pulse width corresponding to the printing data generated by the head chip.

5. The apparatus of claim 1, further comprising:

an error display unit, wherein, if the signal indicating that the serial clock signal is abnormal is enabled in the clock monitoring unit, reading the signal indicating that the serial clock signal is abnormal and displaying an error message.

6. A method of protecting an inkjet printer head comprising a head controller of a printer body and a head chip for driving a heater by using a serial interface, the method comprising:

performing sampling with regard to a serial clock signal that is used as a reference clock signal supplied to the head chip from the head controller to control the head chip at a frequency higher than a frequency of the serial clock signal;

counting a number of clocks including continuous 0 or 1 in the sampled clock signal;

determining that the serial clock signal is abnormal if a count value is greater than a previously established value; and limiting energy applied to the heater of the printer head if the serial clock signal is abnormal.

7. The method of claim 6, wherein the limiting of energy comprises:

limiting driving of the heater by performing a logical operation with regard to the signal indicating that the serial clock signal is abnormal, a head driving signal having a heater driving pulse width corresponding to printing data generated by the head chip, and a signal for limiting a pulse width of the head driving signal to prevent the heater from electrically burning out.

8. The method of claim 6, further comprising:

reading the signal indicating that the serial clock signal is abnormal and displaying an error message if it is determined that the signal indicating that the serial clock signal is abnormal.

9. A protection apparatus of an inkjet printer having a head controller, a heater, and a head chip to drive the heater, the protection apparatus comprising:

a clock monitoring unit to determine whether a first signal representing a reference clock signal from the head controller used to control the head chip is in a first condition or in a second condition, the first condition representing a normal first signal and the second condition representing an abnormal first signal, and to output a signal according to the determination; and a heater driving limiting unit to directly receive the signal from the clock monitoring unit and to limit energy applied to the heater when the first signal is in the second condition.

10. The protection apparatus of claim 9, wherein the clock monitoring unit comprises:

a clock sampling unit to sample the first signal at a frequency higher than a frequency of the first signal;

a clock counter to count a number of clocks including continuous 0 or 1 in the sampled first signal; and an abnormal clock signal determination unit to compare a count value obtained by the clock counter with a predetermined value and to output a second signal representing an abnormal first signal when the count value is larger than the predetermined value.

11. The apparatus of claim 10, wherein the heater driving limiting unit limits driving of the heater according to the second signal, a third signal having a pulse width corresponding to printing data generated by the head chip, and a fourth signal to limit a pulse width of the third signal to protect the heater.

12. An apparatus to protect an inkjet printer head having a head controller and a heater, the apparatus comprising:

a head chip to receive printing data from the head controller and to output a heater driving pulse width corresponding to the printing data and a reference clock signal to the heater and to output a signal according to a determination of a normal state and abnormal state of the reference clock signal; and a heater driving limiting unit to directly receive the output signal of the head chip and to control a width of the heater driving pulse width output to the heater based on a condition of the printing data and the reference clock signal.

13. The apparatus according to claim 12, further comprising a clock monitoring unit to determine whether the printing data and the reference clock signal is in a normal condition or in an abnormal condition, wherein the heater driving limiting unit to limit energy output to the heater when at least one of the printing data and the reference clock signal is in the abnormal condition.

14. An image forming apparatus having a heater and a head chip to drive the heater, comprising:

a clock monitoring unit to monitor a reference signal to control the head chip, the reference signal being abnormal or normal, and to output a signal according to a state of the reference signal; and a controller to directly receive the signal from the clock monitoring unit and to control the head chip to restrict driving of the heater according to characteristic of the reference signal.

15. The protection apparatus of claim 14, wherein the clock monitoring unit comprises:

a clock sampling unit to sample the reference signal at a frequency higher than a frequency of the reference signal;

a clock counter to count a number of clocks including continuous 0 or 1 in the sampled reference signal; and an abnormal clock signal determination unit to compare a count value obtained by the clock counter with a predetermined value and to output a second signal representing an abnormal reference signal when the count value is larger than the predetermined value.

16. The apparatus of claim 14, wherein the controller limits driving of the heater according to the second signal, a third signal having a pulse width corresponding to printing data generated by the head chip, and a fourth signal to limit a pulse width of the third signal to protect the heater.

* * * * *